United States Patent [19]

Heilman et al.

[11] Patent Number: 5,074,424

[45] Date of Patent: Dec. 24, 1991

[54] IRREVERSIBLE TAMPER INDICATOR FOR MECHANICAL BUTTON CAP

[75] Inventors: Robert J. Heilman, Orland Park; Harry W. Ingersol, Carpentersville, both of Ill.

[73] Assignee: Continental White Cap, Inc., Downers Grove, Ill.

[21] Appl. No.: 574,260

[22] Filed: Aug. 30, 1990

[51] Int. Cl.[5] ..... B65D 43/00

[52] U.S. Cl. ..... 215/230; 215/250; 215/253

[58] Field of Search ..... 215/230, 250, 253

[56] References Cited

U.S. PATENT DOCUMENTS

| | | | |
|---|---|---|---|
| 4,579,240 | 4/1986 | Ou-Yang | 215/230 |
| 4,674,641 | 6/1987 | Rusinyak | 215/230 |
| 4,872,570 | 10/1989 | Harding | 215/230 |
| 4,877,143 | 10/1989 | Travisano | 215/230 |
| 5,018,632 | 5/1991 | Schmidt | 215/230 |

*Primary Examiner*—Stephen Marcus
*Assistant Examiner*—Nova Stucker
*Attorney, Agent, or Firm*—Lockwood, Alex, FitzGibbon & Cummings

[57] ABSTRACT

This relates to the provision of a closure having a mechanically actuated button with a tamper indicating arrangement. A transparent panel overlies the end panel of the closure and there is provided a message indicia either on the upper surface of the button or the under surface of the transparent panel with their being carried by the transparent panel a pleated screen which shields the message indicia either by overlying the same or by blending with the message indicia in color. One end of the pleated screen is fixedly attached to the transparent panel while the opposite end has a releasable bond. When the closure is applied and the mechanical button moves towards the transparent panel, the pleated screen is clamped between the two with the result that the pleated screen is flattened and elongated rupturing the releasable bond so that once the closure is removed from the container and the button moves down away from the transparent panel, the pleated screen can collapse exposing the message indicia. This process is irreversible with the message indicia remaining exposed to indicate prior removal and replacement of the closure.

8 Claims, 1 Drawing Sheet

IRREVERSIBLE TAMPER INDICATOR FOR MECHANICAL BUTTON CAP

This invention relates in general to new and useful improvements in closure caps for containers, and more particularly to a closure cap with a mechanical button and wherein there is associated with the button an irreversible tamper indicator.

BACKGROUND OF THE INVENTION

This invention involves a closure cap with a mechanically actuated button developed by Robert J. Heilman and which is the subject of a co-pending, previously filed, U.S. application. This closure cap is provided with a button which has associated therewith a plurality of dome shaped mechanical actuators formed adjacent to the button in an end panel of the closure cap. The button, in the originally formed condition of the closure cap is in a down position and when applied to a container is mechanically actuated to a deflected upper position. When the closure is removed the end panel of the closure results in the button snapping back to its original lowered position.

SUMMARY OF THE INVENTION

The mechanical button as developed by Robert J. Heilman per se is deficient from a tamper indicating standpoint in that the button merely moves up and down and the position of the button only indicates whether or not the closure is fully applied to a container. If the closure is applied to a container, then removed from the container and reapplied, the position of the button per se in no way indicates the removal and replacement of the closure.

In accordance with this invention, there is provided a tamper indicating device in the form of a pleated screen which normally shields a message indicia, which screen, when the closure is applied, has one end thereof disengaged so that when the closure is removed from the container, the pleated screen will shorten or collapse thereby making the message indicia readily visible.

When the closure is reapplied with the pleated screen in its collapsed position, the message indicia remains visible. Further, the pleated screen prevents the normal movement of the button to its elevated position thereby additionally indicating tampering.

With the above and other objects in view that will hereinafter appear, the nature of the invention will be more clearly understood by reference to the following detailed description, the appended claims, and the several views illustrated in the accompanying drawings.

DESCRIPTION OF PREFERRED EMBODIMENTS OF THE INVENTION

Figure 1:
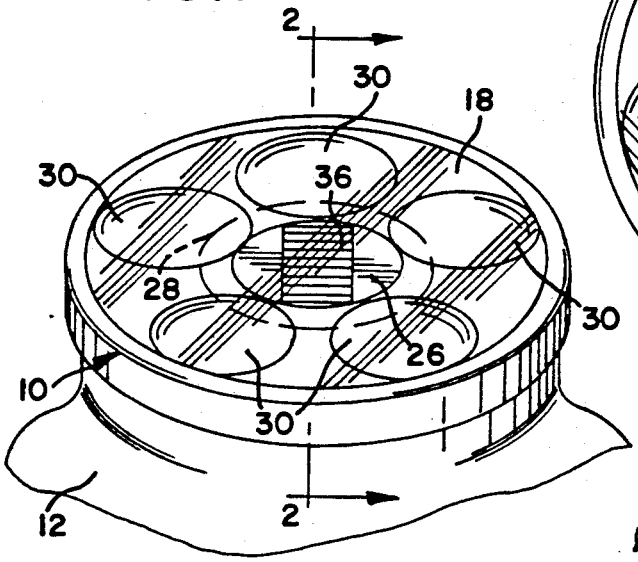
FIG. 1 is a top perspective view of a closure formed in accordance with this invention and shows the same applied to a container.
Figure 2:
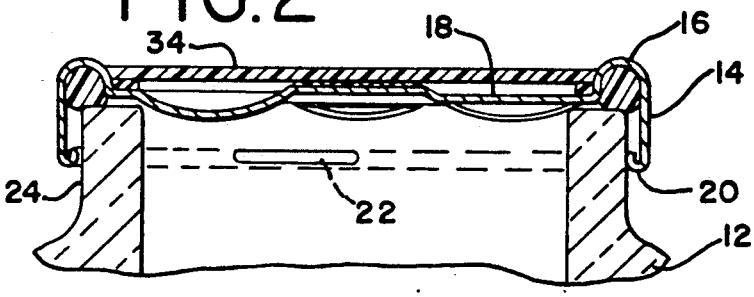
FIG. 2 is a fragmentary transverse vertical sectional view taken generally along the line 2—2 of FIG. 1 and further shows the constructional details of the closure and the mechanical actuation of the button.

Referring now to the drawings in detail with particular reference to FIGS. 1 and 2, it will be seen that there is illustrated a closure or closure cap generally identified by the numeral 10 applied to a container 12 in closing relation. The closure 10, as is best shown in FIG. 2, includes a generally cylindrical skirt 14 which terminates at its upper edge in a reversely turned channel forming portion 16 which carries a sealing ring. AN end panel 18 extends within the channel forming portion 16. The skirt 14 terminates at its lower edge in an inwardly turned curl 20 which is flattened at intervals to form attaching lugs 22 which engage beneath projecting ears or lugs on a neck finish 24 of the container 12.

Figure 5:
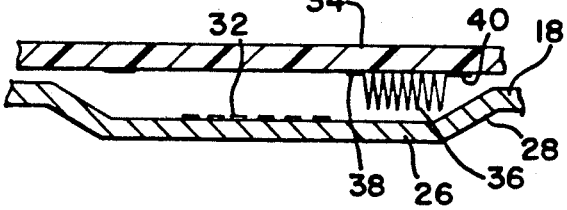
FIG. 5 is another enlarged fragmentary vertical sectional view showing the closure removed from the container and the button back in its normal down position and the pleated screen in its collapsed state.

The end panel 18 is provided with a centrally located circular button 26 which is maintained in a normally lower position by an annular sloping portion 28 as shown in FIG. 5.

The end panel 18 also carries in surrounding relation with respect to the button 26 a plurality of mechanical actuators in the form of downwardly domed elements 30. The mechanical actuators 30 are so associated with the annular portion 28 so that when they are engaged by an upper end of the container neck finish 24, they are deformed and, in turn, effect a reversal of the slope of the annular portion 28 to the position shown in FIG. 4 with the result that the button 26 moves from its lower position of FIG. 5 to its upper position of FIG. 4.

The closure 10, as described above, is improved in accordance with this invention by the form of the invention illustrated in FIGS. 3–6 having applied to the upper surface of the button 26 message indicia 32 such as the word "OPENED". Further, there is applied to the closure 10 a transparent panel 34 which is mounted in spaced relation above the end panel 18 and in sealed relation relative to the closure 10 in the manner best shown in FIG. 2.

In accordance with the invention, there is carried by the underside of the transparent panel 34 a pleated screen 36 having mounting flanges 38 and 40 at opposite ends thereof. In accordance with this invention, the flange 40 has a permanent bond 42 with the underside of the transparent panel 34 and a weak rupturable bond 44 between the flange 38 and the underside of the transparent panel 34.

Figure 4:
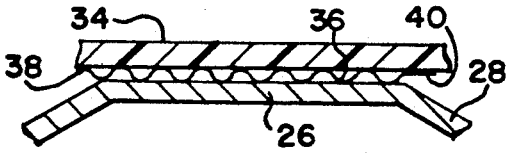
FIG. 4 is an enlarged fragmentary vertical sectional view similar to FIG. 3 and shows the button in its elevated actuated position with the pleated screen having been separated from the transparent panel at one end of the pleated screen.
Figure 3:
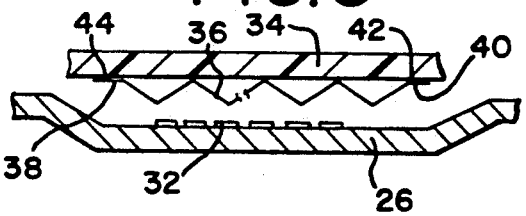
FIG. 3 is an enlarged fragmentary sectional view taken through the button of the closure showing specifically the relationship of the button to an overlying transparent panel and the pleated screen carried by the transparent panel.

As is clearly shown in FIG. 3, the pleated screen 36 overlies and covers the message indicia 32 so that it is not visible. This condition exists in the closure 10 as formed and when applied to the container 12. However, when the closure 10 is applied to the container 12 and the button 26 is mechanically moved to its upper position as shown in FIG. 4, the pleated screen is tightly clamped between the button 26 and the underside of the transparent panel 34 with the result that the pleated screen 36 is flattened and thereby elongated. The net result is that the bond 42 between the flange 40 and the transparent panel 34 remains fixed while the bond 44 between the flange 38 and the transparent panel 34 is ruptured and the left end of the pleated screen 36 moves to the left as shown in FIG. 4.

Figure 7:
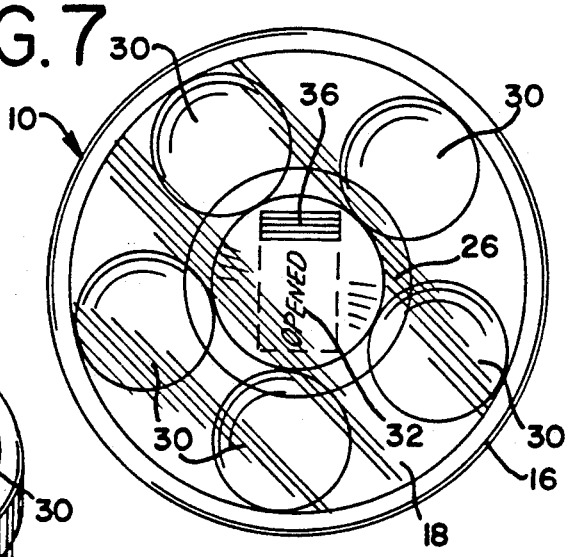
FIG. 7 is a top plan view of the closure as it would appear when reapplied to the container with the message indicia exposed.

Then when the closure 10 is removed from the container 12 and the button 26 again assumes its lower position as shown in FIG. 5, the flange or flap 38 having been released from the transparent panel 34 and the pleated screen 36 remaining attached to the underside of the transparent panel 34 by way of the flange or flap 40, the pleated screen 36 shortens or collapses uncovering the message indicia 32. This is clearly shown in FIG. 7.

Figure 6:
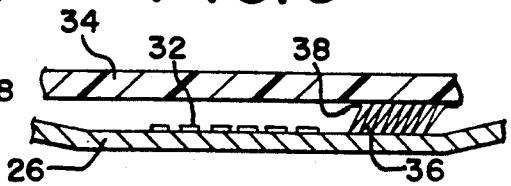
FIG. 6 is still another enlarged fragmentary vertical sectional view showing the closure in its reapplied position with the button partially elevated but restrained against further elevation by the collapsed pleated screen.

Assuming that one has removed the closure 10 from the container 12 for the purpose of tampering with the contents of the container 12 and the closure 10 is reapplied, it will be seen from FIG. 6 that the pleated screen 36 remains in its collapsed or shortened state with the message indicia 32 continuing to be exposed. Further, the pleated screen 36 being in a somewhat compact state, is not free to collapse as occurred in FIG. 4, and prevents the full upward movement of the button 26 thereby giving further evidence that the container 12 has been previously opened and reclosed.

Figure 8:
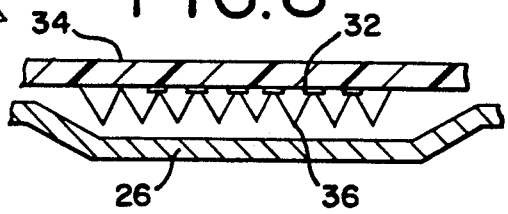
FIG. 8 is an enlarged fragmentary sectional view similar to FIG. 3 but shows the message indicia carried by the underside of the transparent panel.

Reference is now made to the modified form of the invention illustrated in FIG. 8 wherein in lieu of the message indicia 32 being applied to the upper surface of the button 26, the message indicia 32 is applied to the under surface of the transparent panel 34. The pleated screen 36 is applied to the underside of the transparent panel 34 in the manner previously described and in overlying relation to the button 26. However, the pleated screen 36, since it now underlies the message indicia 32, must be of a color wherein the message indicia 32 blends into the background provided by the pleated screen 36 so as to not be readily observable.

With the arrangement shown in FIG. 8, the same mechanical action of the button 26 occurs as shown in FIG. 4 followed by the shortening or retraction of the pleated screen 36 when the closure 10 is removed from the container 12. The background now provided by the button 26 makes the message indicia 32 readily visible.

Although only several preferred embodiments of the invention have been specifically illustrated and described herein, it is to be understood that minor variations may be made in the tamper indicating arrangement without departing from the spirit and scope of the invention as defined by the appended claims.

We claim:

1. A closure having a condition indicating button mechanically elevated when said closure is applied to a container, a transparent panel carried by said closure is spaced in overlying relation to said button, a message viewable through said transparent panel, and a pleated screen carried by said transparent panel and normally shielding said message indicia, said pleated screen being permanently attached at one end to said transparent panel and releasably attached at an opposite end to said transparent panel whereby when said pleated screen is clamped between said transparent panel and said button upon application of said closure and elevation of said button said releasably attached end is released.

2. A closure according to claim 1 wherein said pleated screen is internally tensioned to effect shortening of said pleated screen and said message indicia becoming viewable when said closure is removed and said button returns to its original position.

3. A closure according to claim 2 wherein said shortened screen forms means restricting elevation of said button when said closure is reapplied and said message indicia remaining visible through said transparent panel.

4. A closure according to claim 1 wherein said message indicia is on said button and said pleated screen initially overlies said message indicia.

5. A closure according to claim 1 wherein said indicia message is on said transparent panel and said pleated screen is of a matching background to blank out said message indicia.

6. A closure according to claim 2 wherein said button has a background causing said message indicia to be readily viewable when said pleated screen is shortened.

7. A closure according to claim 6 wherein said message indicia is on said button and said pleated screen initially overlies said message indicia.

8. A closure according to claim 6 wherein said indicia message is on said transparent panel and said pleated screen is of a matching background to blank out said message indicia.

* * * * *